US007536138B2

(12) United States Patent
Hirota

(10) Patent No.: US 7,536,138 B2
(45) Date of Patent: May 19, 2009

(54) DEVELOPER WITH DEVELOPER LEVEL CONTROL, AND IMAGE FORMING APPARATUS HAVING SAME

(75) Inventor: Takashi Hirota, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 114 days.

(21) Appl. No.: 11/783,503

(22) Filed: Apr. 10, 2007

(65) Prior Publication Data

US 2007/0242981 A1 Oct. 18, 2007

(30) Foreign Application Priority Data

Apr. 14, 2006 (JP) ..... 2006-112781

(51) Int. Cl.
*G03G 15/08* (2006.01)

(52) U.S. Cl. ..... 399/254; 399/256; 399/258

(58) Field of Classification Search ..... 399/254, 399/256, 258, 257, 260; 222/DIG. 1
See application file for complete search history.

(56) References Cited

U.S. PATENT DOCUMENTS

| | | | | |
|---|---|---|---|---|
| 5,150,135 | A * | 9/1992 | Casey et al. | 399/260 X |
| 5,430,530 | A * | 7/1995 | Ott et al. | 399/256 |
| 5,572,299 | A | 11/1996 | Kato et al. | 399/256 |
| 6,421,516 | B1 | 7/2002 | Kinoshita et al. | 399/254 |
| 6,470,164 | B1 * | 10/2002 | Fukuyama | 399/257 |
| 6,505,022 | B2 * | 1/2003 | Kosuge et al. | 399/258 X |
| 7,039,344 | B2 * | 5/2006 | Nishiyama | 399/254 |
| 2002/0025195 | A1 * | 2/2002 | Iwata et al. | 399/258 |
| 2002/0025197 | A1 * | 2/2002 | Mizoguchi et al. | 399/258 X |
| 2003/0026628 | A1 * | 2/2003 | Arimoto | 399/258 X |
| 2007/0231015 | A1 * | 10/2007 | Sakamaki | 399/257 |

FOREIGN PATENT DOCUMENTS

| | | | |
|---|---|---|---|
| JP | 2-21591 | B2 | 5/1990 |
| JP | 7-121021 | A | 5/1995 |
| JP | 2000-81787 | A | 3/2000 |
| JP | 2000-321872 | A | 11/2000 |
| JP | 2001-092253 | A * | 4/2001 |
| JP | 2001-265098 | A | 9/2001 |
| JP | 2004-163559 | A | 6/2004 |

* cited by examiner

*Primary Examiner*—Sophia S Chen
(74) *Attorney, Agent, or Firm*—Nixon & Vanderhye, PC

(57) ABSTRACT

In the development apparatus and the image forming apparatus of the present invention, a first regulation member for regulating an upper surface of developer is provided on an adjacent and downstream portion with respect to a developer outlet in terms of travel direction of developer. The amount of developer passing below the first regulation member is thus adjusted. On this account, the present invention provides a development apparatus and an image forming apparatus capable of maintaining appropriate amount of developer in the developer container by reducing influence of developer fluidity or the like. With stable stirring performance and development performance, the development apparatus and the image forming apparatus of the present invention perform secure development, including the time period until the extra developer overflows and is discharged.

18 Claims, 5 Drawing Sheets

DEVELOPER WITH DEVELOPER LEVEL CONTROL, AND IMAGE FORMING APPARATUS HAVING SAME

This Nonprovisional application claims priority under 35 U.S.C. § 119(a) on Patent Application No. 2006/112781 filed in Japan on Apr. 14, 2006, the entire contents of which are hereby incorporated by reference.

FIELD OF THE TECHNOLOGY

The present technology relates to a development apparatus mounted to an image forming apparatus of electrophotography mode such as photocopier, printer, facsimile, etc., particularly to a development apparatus which develops an electrostatic latent image formed on the surface of a photo conductor (image carrier), using two-component developer constituted of toner and carrier.

BACKGROUND OF THE TECHNOLOGY

An image forming apparatus of electrophotography mode often includes a development apparatus which develops (visualizes) an electrostatic latent image formed on the surface of a photo conductor (image carrier), using two-component developer (hereinafter may be simply referred to as developer) constituted of toner and carrier. In the development apparatus using two-component developer, the toner is consumed in each time of development operation, but the carrier is not consumed and remains as such in the apparatus. The carrier is stirred in the development apparatus with the toner, and as the stirring frequency increases, the carrier deteriorates due to so-called spent that causes removal of resin coat layer from the surface of carrier and causes the toner to be adhered to the carrier surface, whereby the charging performance of developer decreases.

Applications disclosing development apparatuses capable of solving this defect have been published. For example, Patent Document 1 discloses a development apparatus supplied with not only re-fill toner by the consumed amount, but also a small amount of carrier, so as to suppress a decrease in charging performance of developer. This development apparatus is arranged to discharge the extra developer resulted from supply of carrier from the developer container. Specifically, the excessive amount of developer overflows the container and is discharged from a developer overflow outlet provided on the wall of the developer container. By thus repeating supply and discharge of developer, the deteriorated developer is constantly replaced with new developer. In this way, charging performance is maintained, whereby decrease in photocopying image quality is prevented.

The development apparatus capable of constantly replacing developer by spilling the extra developer from a developer overflow outlet is however required to appropriately adjust the amount of developer in the developer container. When the developer container contains an excessively large amount of toner, the developer is not sufficiently stirred, and uneven coloring or fog occurs. On the other hand, when the developer container contains excessively small amount of toner, the image forming of electrostatic latent image is carried out with insufficient amount of developer, which results in density irregularity, blank spots on image or the like.

To appropriately adjust the developer in the developer container, it is necessary to rapidly discharge the extra developer when excessively large amount of toner is supplied to the developer container. On the contrary, it is also necessary to decrease the discharge amount of developer when the amount of the developer in the developer container is insufficient.

In a developer container in which the surface height of developer is constant, a small increase in developer amount from the appropriate range in the developer container causes a small increase in height of developer surface, and therefore, only a small amount of developer flows outside as it comes above the lower end of the developer discharging outlet. It therefore takes a while to refill the developer container until it reaches the appropriate range.

In view of this problem, some technologies for maintaining an appropriate amount of developer in a developer container have been suggested. For example, Patent Document 2 discloses provision of a rotary wing in a carriage member (screw etc.) for carrying developer which allows local increase in height of developer surface in the region where the developer outlet is provided.

With this structure, a part of the surface of the developer corresponding to the rotary wing increases, and the developer starts to be discharged from the developer outlet when the surface height reaches a certain height, and the discharge amount increases in proportion to the excess toner. In this way, the foregoing structure prevents excessive increase in developer amount in the developer container.

The increased part of the surface of the developer corresponding to the rotary wing is however not discharged if the surface height falls below the certain height. On this account, the height of the developer in the developer container does not excessively decrease.

Further, Patent Document 3 discloses a developing apparatus including a developer outlet in a downstream portion of the carriage direction of developer carried by a stirring/carrying member (stirring carriage means), and regulation member (regulating means) having a rotary wing between the stirring/carrying member and the developer outlet. The regulation member serves to regulate the movement of developer toward the developer outlet, and also carry the developer in the reverse direction, thereby increasing the height of a part of the surface (projection part) of developer in front of the developer outlet (in the vicinity of the continuous entrance allowing the developer to circulate in the developer tank).

In this manner, when the developer amount in the developer container increases due to supply of new developer, the surface of the projection part of developer comes higher than the lower end of the developer outlet, and the part which came higher than the lower end is discharged as excess developer.

Further, with the provision of regulation plate to the continuous entrance, the change in surface height of the projection part in response to developer supply occurs more intensively.

Patent Document 1: Japanese Examined Patent Publication Tokukohei 2-21591 (published on May 15, 1990)]

Patent Document 2: Japanese Unexamined Patent Publication Tokukai 2000-81787(published on Mar. 21, 2000)

Patent Document 3: Japanese Unexamined Patent Publication Tokukai 2001-265098 (published on Sep. 28, 2001)]

Patent Document 4: Japanese Unexamined Patent Publication Tokukaihei 5-127537 (published on May 25, 1993)]

Patent Document 5: Japanese Unexamined Patent Publication Tokukai 2001-92253(published on Apr. 6, 2001)

However, the foregoing conventional structure of development apparatus does not secure high accuracy in regulation of the discharge amount of excess developer. Particularly, when the fluidity of developer is changed, the developer amount in the developer container cannot be kept within the appropriate range, and some defects may occur due to variation of the developer amount in the developer container.

Specifically, in the structures of the foregoing Patent Documents 2 and 3 in which a projection is formed on the surface of developer in front of the developer outlet by a rotary wing provided in a rotation member (screw etc.), the height of the projection can be easily changed by other parameters than the developer amount. A likely parameter which can change the height is a change in developer fluidity, for example.

To be more specific, even with the same developer amount in the developer container, the projection forms a gentle curve and the surface height is low when the developer fluidity is high; but the projection forms a rapid curve and the surface height is high when the developer fluidity is low. For this reason, under high fluidity, the actual discharge amount becomes less than the assumed amount. On the other hand, under low fluidity, the actual discharge amount becomes greater than the assumed amount. The adjustment of developer amount in the developer container within an appropriate range is therefore cannot be secured.

Further, when the developer amount in the developer container is large, a larger amount of developer needs to be stirred and carried until the excess developer is discharged. This causes a problem of unstable stirring or developing performance, which makes development operation insecure.

SUMMARY OF THE TECHNOLOGY

An object is to provide a development apparatus capable of maintaining appropriate amount of developer in the developer container by reducing influence of developer fluidity or the like. With stable stirring performance and development performance, the development apparatus performs secure development, including the time period until the extra developer overflows and is discharged. The present technology also provides an image forming apparatus including the development apparatus.

In order to attain the foregoing objective, a development apparatus comprises: a developer container for containing developer made of carrier and toner, said developer container having an opening opposite an electrostatic latent image carrier, a developer supply inlet through which new developer including carrier is supplied, and a developer outlet through which developer is discharged; a developer carrier for holding and carrying developer, rotatably positioned in a portion facing to the opening of said developer container; a developer stirring/carrying mechanism, rotatably provided in a rear side of said developer carrier, for carrying the developer into a direction in parallel to an axis of the developer carrier, while stirring the developer; and a first regulation member for regulating an upper surface of developer, provided on an adjacent and downstream portion with respect to said developer outlet in terms of travel direction of developer carried by said developer stirring/carrying mechanism.

An image forming apparatus includes the foregoing development apparatus of the present disclosure.

With this arrangement having a first regulation member, the upper surface of the developer carried by the first stirring/carrying member is regulated, and only the part passing below the first regulation member is carried to the downstream side. Therefore, in the upstream portion of the first regulation member in the developer carriage direction, the developer blocked by the first regulation member is accumulated, and the upper surface of the developer increases. Since the first regulation member and the developer outlet are adjacent to each other, the developer with the increased surface overflows, and is discharged from the developer outlet.

The amount of developer passing through the first regulation member is constant regardless of the amount of developer stored in the developer container. Therefore, the increase in amount of extra developer in the developer container proportionally increases the height of upper surface of the developer blocked and accumulated in the developer container.

Moreover, in the downstream of the first regulation member in the developer carriage direction, the amount of developer is regulated by the first regulation member, and therefore is basically constant even though the amount varies due to supply or consumption during the return travel to the upstream of the first regulation member. The change in height of upper surface of the developer container due to the increase in developer amount thus appears intensively in the upstream portion of the first regulation member in the developer carriage direction.

Therefore, even if the change in height of upper surface is small for the whole developer container, it appears intensively in a certain point, and therefore appears as a large change in surface height in the vicinity of the developer outlet. Consequently, it becomes possible to discharge the extra developer right away from the developer outlet. The developer amount in the developer container is thus kept within an appropriate range.

Moreover, since the surface projection of extra developer is caused by the blockage of developer by the first regulation member, it is not easily affected by other parameters than the developer amount (such as the developer fluidity etc.), compared with the projection formed by a stirring wing of the carriage screw.

Therefore, in spite of slight variation due to the developer fluidity, the height of the projection proportionally increases with an increase of extra developer, that is it proportionally decreases with a decrease of extra developer. This arrangement allows not only quick discharge of extra developer, but also suppressing influence of developer fluidity etc., thereby maintaining the developer amount in the developer container within an appropriate range.

Further, in the area outside the developer accumulation region in the upstream of the first regulation member, the surface height of the developer is kept constant. Therefore, the development is securely performed with stable stirring performance and development performance, including the time period until the extra developer overflows and is discharged.

With this effect, another development apparatus and image forming apparatus is also capable of maintaining appropriate amount of developer in the developer container by reducing influence of developer fluidity or the like. With stable stirring performance and development performance, the development apparatus performs secure development, including the time period until the extra developer overflows and is discharged.

In order to attain the foregoing objective, a development apparatus comprises: a developer container for containing developer made of carrier and toner, said developer container having an opening opposite an electrostatic latent image carrier, a developer supply inlet through which new developer including carrier is supplied, and a developer outlet through which developer is discharged; a developer carrier for holding and carrying developer, rotatably positioned in a portion facing to the opening of said developer container; a developer stirring/carrying mechanism, rotatably provided in a rear side of said developer carrier, for carrying the developer into a direction in parallel to an axis of the developer carrier, while stirring the developer, said developer stirring/carrying mechanism having first and second stirring/carrying members and a partition plate for separating the first and second stirring/carrying members except for ends of said first and second stirring/carrying members; and a first regulation member for regulating an upper surface of developer, provided in a carriage path of the first stirring/carrying member which resides in a portion more distant from said developer carrier then the second stirring/carrying member, said developer outlet is formed on an adjacent and upstream portion with respect to said first regulation member in terms of travel direction of developer.

Another image forming apparatus includes the foregoing development apparatus of the present disclosure.

In this structure, the developer stirring/carrying mechanism is constituted of first and second stirring/carrying members and a partition plate for separating the first and second stirring/carrying members except for ends of said first and second stirring/carrying members.

The provision of first and second stirring/carrying member enables circulation carriage, and the partition plate allows the two carriage paths to be separated. The efficiencies of stirring and carriage thus increase.

In this structure, the first regulation member is provided in a carriage path of the first stirring/carrying member which is more distant from the developer carrier than the second stirring/carrying member. This structure thus ensures the same effect as that of the foregoing development apparatus.

With this effect, another development apparatus and image forming apparatus is also capable of maintaining appropriate amount of developer in the developer container by reducing influence of developer fluidity or the like. With stable stirring performance and development performance, the development apparatus performs secure development, including the time period until the extra developer overflows and is discharged. The present technology also provides an image forming apparatus including the development apparatus.

Additional objects, features, and strengths will be made clear by the description below. Further, the advantages will be evident from the following explanation in reference to the drawings.

DESCRIPTION OF THE EMBODIMENTS

The present technology is applicable to an image forming apparatus of electrophotography mode such as photocopier, printer, facsimile, etc., which carries out development using a two-component developer constituted of toner and carrier.

First Embodiment

Figure 2:
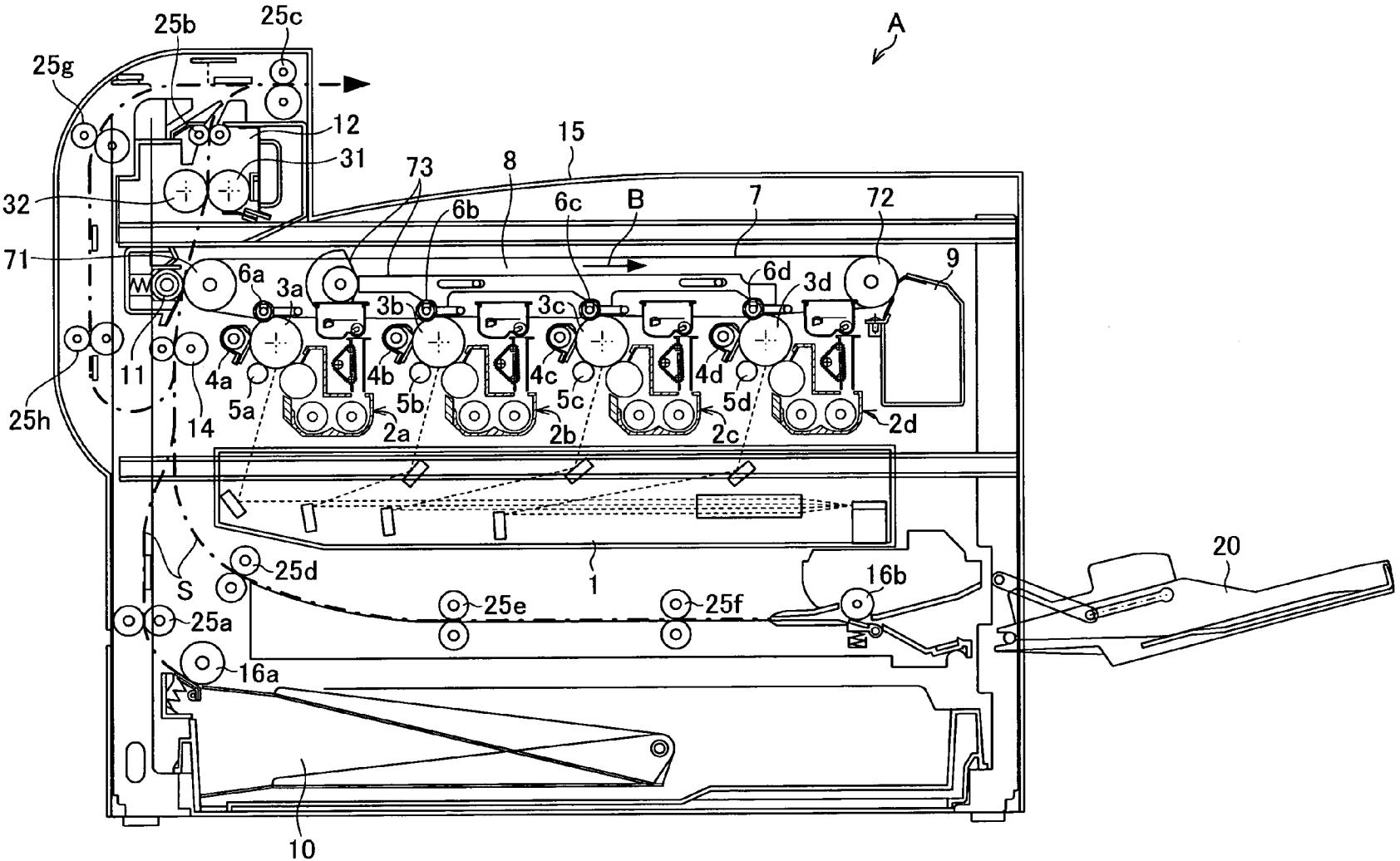
FIG. 2 is an explanatory view of an image forming apparatus including the development apparatus shown in FIG. 1.

FIG. 2 is a vertical cross-sectional view showing a structure of an image forming apparatus A according to the present embodiment. The image forming apparatus A of the present embodiment (hereinafter simply referred to as the image forming apparatus) forms multicolor and monochrome images on predetermined sheets (recording medium) based on image data externally supplied. As shown in FIG. 2, the image forming apparatus A mainly includes exposure units 1, development units 2, photoconductive drums 3, chargers 5, cleaner units 4, an intermediate transfer belt unit 8, a fixing unit 12, a paper carriage path S, a paper feeder cassette 10 and a discharge tray 15.

The image forming apparatus A handles color image data expressed by black(K), cyan(C), magenta(M), and yellow (Y). The image forming apparatus therefore includes four development units 2 (2*a*, 2*b*, 2*c*, 2*d*), four photoconductive drums 3 (3*a*, 3*b*, 3*c*, 3*d*), four chargers 5 (5*a*, 5*b*, 5*c*, 5*d*), and four cleaner units 4 (4*a*, 4*b*, 4*c*, 4*d*), so as to form four latent images of those colors. In each unit, the reference numeral "a" corresponds to black, and "b", "c" and "d" correspond to cyan, magenta, and yellow, respectively. They are thus broken into four image stations.

Each photoconductive drum 3 has a photoconductor layer on its surface, and forms thereon an electrostatic latent image through charging and exposure, according to image data. Each charger 5 serves as a charging apparatus (charging means) for evenly charging the surface of the corresponding photoconductive drum 3 to a predetermined potential. Though the figure illustrates a contact-type charging roller, the charger 5 may be another type charger, such as a charging brush, or a charging device (eg. corona charger).

Each exposure unit 1 serves to carry out exposure of the corresponding photoconductive drum 3 having been charged, according to supplied image data so as to form an electrostatic latent image corresponding to the image data on the surface of the photoconductive drum. In FIG. 2, each exposure unit 1 is realized by a laser scanning unit (LSU) containing a laser irradiation section and a reflection mirror. Note that, the exposure unit 1 may be made of an EL (electro luminescence) or LED (light emitting diode) writing head in which light emitting elements are aligned in an array manner.

Each development unit 2 includes a development apparatus for visualizing an electrostatic latent image on the corresponding photoconductive drum into a toner image using the two component developer of each color (K, C, M, Y) constituted of toner and carrier; and a developer hopper for storing supplemental developer containing toner and carrier. The structure of the development unit 2 is described later.

Each cleaner unit 4 serves to remove/collect residue toner on the surface of the corresponding photoconductive drum 3 after the image is transferred from the photoconductive drum 3.

The intermediate transfer belt unit 8 provided above the photoconductive drums 3 serves to superimpose plural toner images resulted from visualization of electrostatic latent images on the photoconductive drums 3 into a single color image. The intermediate transfer belt unit 8 includes an intermediate transfer belt (transfer material) 7, an intermediate transfer belt driving roller 71, an intermediate transfer belt tension roller 73, an intermediate transfer belt co-driving roller 72, intermediate transfer rollers 6 (6*a*, 6*b*, 6*c*, 6*d*), and an intermediate transfer belt cleaning unit 9.

The intermediate transfer belt driving roller 71, the intermediate transfer belt tension roller 73, the intermediate transfer roller 6, and the intermediate transfer belt co-driving roller 72 suspends the intermediate transfer belt 7, and also rotates the intermediate transfer belt 7 in the B-direction of the figure.

The intermediate transfer belt 7 is so provided as to be in contact with the corresponding photoconductive drum 3. The plural toner images formed on the respective photoconductive drums 3 are sequentially transferred (first transfer) onto the intermediate transfer belt 7, being superimposed on each other, so that a multicolor toner image is formed on the intermediate transfer belt 7.

The intermediate transfer belt 7 is formed of a film with a thickness of about 100 μm to 150 μm in the form of a loop.

The toner images on the photoconductive drums 3 are transferred to the intermediate transfer belts 7 by the intermediate transfer rollers 6 in contact with the rear surface of the intermediate transfer belt 7.

The intermediate transfer roller 6 is rotatably held by an intermediate transfer roller attachment section of the intermediate transfer belt tension roller 73. A high-voltage transfer bias (a high voltage with opposite polarity (+) to the voltage for charging toner (−)) for enabling toner image transfer is applied to the intermediate transfer roller 6. The intermediate transfer roller 6 discharges the transfer bias. The transfer bias enables the toner images on the photoconductive drums 3 to be transferred onto the intermediate transfer belt 7.

Each transfer roller 6 is made of a metal (such as a stainless) axis with a diameter of 8 mm-10 mm, covered by an elastic conductive material (for example, EPDM (ethylene propylene dien monomer), urethane foam etc.), that allows uniform application of a high voltage to intermediate transfer belt 7. Though the present embodiment uses the intermediate transfer roller 6 as a transfer electrode for applying the transfer bias, a brush-shaped electrode etc. may be used instead.

In this manner, the plural electrostatic latent images on the photoconductive drums 3 visualized according to the respective hues are layered on the intermediate transfer belt 7, into a multicolor toner image corresponding to the image data supplied to the apparatus.

The multicolor toner image constituted of layered toner images is transported by rotation of the intermediate transfer belt 7 to a secondary transfer position in which the sheet and the intermediate transfer belt 7 come in contact with each other, and is transferred onto a sheet by a transfer roller 11 (transfer apparatus) provided in the secondary transfer position. The intermediate transfer belt 7 and the transfer roller 11 are in close contact with pressure by a predetermined nip.

The transfer roller 11 is supplied with a voltage (transfer voltage) for enabling toner transfer into a sheet (second transfer). The transfer roller 11 discharges the transfer voltage (a high-voltage with opposite polarity (+) to the voltage for charging toner (−)).

Hereinafter, the transfer from the intermediate transfer belt 7 to a sheet is referred to as the second transfer, and the voltage applied to the transfer roller 11 is referred to as the second transfer voltage, so as to distinguish this transfer from the transfer from the photoconductive drum 3 to the intermediate transfer belt 7.

Further, to constantly provide the same nip between the transfer roller 11 and the intermediate transfer belt driving roller 71, one of the transfer roller 11 and the intermediate transfer belt driving roller 71 is formed of a solid material (eg. metal) and the other is formed of a soft material such as a elastic roller (elastic rubber roller, or resin foam roller etc.).

The residue toner on the intermediate transfer belt 7, that is the toner having not been transferred onto the sheet by the transfer roller 11, may cause color mixing in the next process. To avoid this, an intermediate transfer belt cleaning unit 9 is provided to remove/collect the toner adhered to the intermediate transfer belt 7.

The intermediate transfer belt cleaning unit 9 includes a cleaning blade that is a cleaning member placed in contact with the intermediate transfer belt 7. The contact portion of the intermediate transfer belt 7 with the cleaning blade is supported by the intermediate transfer belt co-driving roller 72 from the rear surface.

A paper feeder cassette 10 is a tray for storing papers (sheets) used for image forming. The paper feeder cassette 10 is provided beneath the exposure unit 1 in the image forming apparatus A.

A discharge tray 15 provided in an upper portion of the image forming apparatus A is a tray for keeping the printed sheets facing down.

The image forming apparatus A also includes a paper carriage path S which is a substantially vertical path serving to carry the sheets from the paper feeder cassette 10 to the discharge tray 15 via the transfer roller 11 or the fixing unit 12.

In the vicinity of the paper carrying path S extending from the paper feeder cassette 10 to the discharge tray 15, apart from the transfer roller 11, pickup rollers 16*a* and 16*b*, a resist roller 14, a fixing unit 12, carriage rollers 25 for carrying sheets etc. are provided.

Each carriage rollers 25 (25*a* to 25*h*) are a pair of small rollers for facilitating/subserving the carriage of sheet. Plural pairs of carriage rollers are provided along the paper carriage path S.

The pickup roller 16*a* is provided on an end portion of the paper feeder cassette 10. The pickup roller 16*a* is a leading roller for supplying the sheets one by one from the paper feeding cassette 10 into the paper carriage path S.

The resist roller 14 temporarily holds a sheet being carried by the paper carriage path S and releases the sheet at a certain timing so as to transfer the sheet into the second transfer position so that the front edge of the toner image thus transferred onto the intermediate transfer belt 7 comes overlaid with the edge of the sheet.

The fixing unit 12 includes a heat roller 31, a pressure roller 32 etc. The heat roller 31 and the pressure roller 32 rotate together with the sheet therebetween.

Further, the heat roller 31 is adjusted to a predetermined temperature by a control section based on a signal detected by a temperature detector (not shown) so as to carry out fixing with a constant fixing temperature. The heat roller 31 and the pressure roller 32 thermally presses the sheet therebetween so as to fuse, mix, press the multicolor toner images so that the toner images are thermally fixed to the sheet.

The sheet with the fixed multicolor toner image is carried to a reverse discharge path of the sheet carriage path S by the carriage rollers 25*b* and 25*c*. And then, the reversed sheet (with the multicolored toner image facing down) is discharged to the discharge tray 15.

The following explains the sheet carriage path. The image forming apparatus A includes a paper feeder cassette 10 for storing the sheets at all times, and also a manual paper feeder tray 20 with which the user can carry out small number of printings without open/close operation of the paper feeder cassette 10. Note that, the pickup roller 16*b* is provided between the manual paper feeder tray 20 and the paper carriage path S to lead the sheets one by one to the paper carriage path S.

The sheet carried from the paper feeder cassette 10 is transferred to the resist roller 14 by the carriage roller 25*a* in the middle of the paper carriage path S. The sheet is then sent to the transfer roller 11 at a certain timing so that the front edge of the toner image on the intermediate transfer belt 7 comes overlaid with the edge of the sheet. The toner image is thus transferred onto the sheet. Then, the sheet passes through the fixing unit 12 where the unfixed toner on the sheet is fused and fixed by heat. The sheet with the fixed image is discharged to the discharge tray 15 via the carriage rollers 25*b* and 25*c* (in the one-side printing mode).

On the other hand, the sheet placed on the manual paper feeder tray 20 is picked up by the pickup roller 16*b*, and then are transferred to the resist roller 14 via the plural carriage rollers 25*f*, 25*d* and 25*e*. The sheet is then undergoes the same processes as those for the sheet from the paper feeder cassette 10, before discharged to the discharge tray 15 (in the one-side printing mode).

At this time, if the double-side printing mode is selected, the bottom edge of the sheet having been through the fixing unit 12 after the one-side printing is caught by the carriage roller 25*c*. Then, inverse rotation of the carriage roller 25*c* leads the sheet to the carriage rollers 25*g* and 25*h* in the paper carriage path S. After that, the sheet undergoes rear side printing through the resist roller 14, before discharged to the discharge tray 15.

Figure 3:
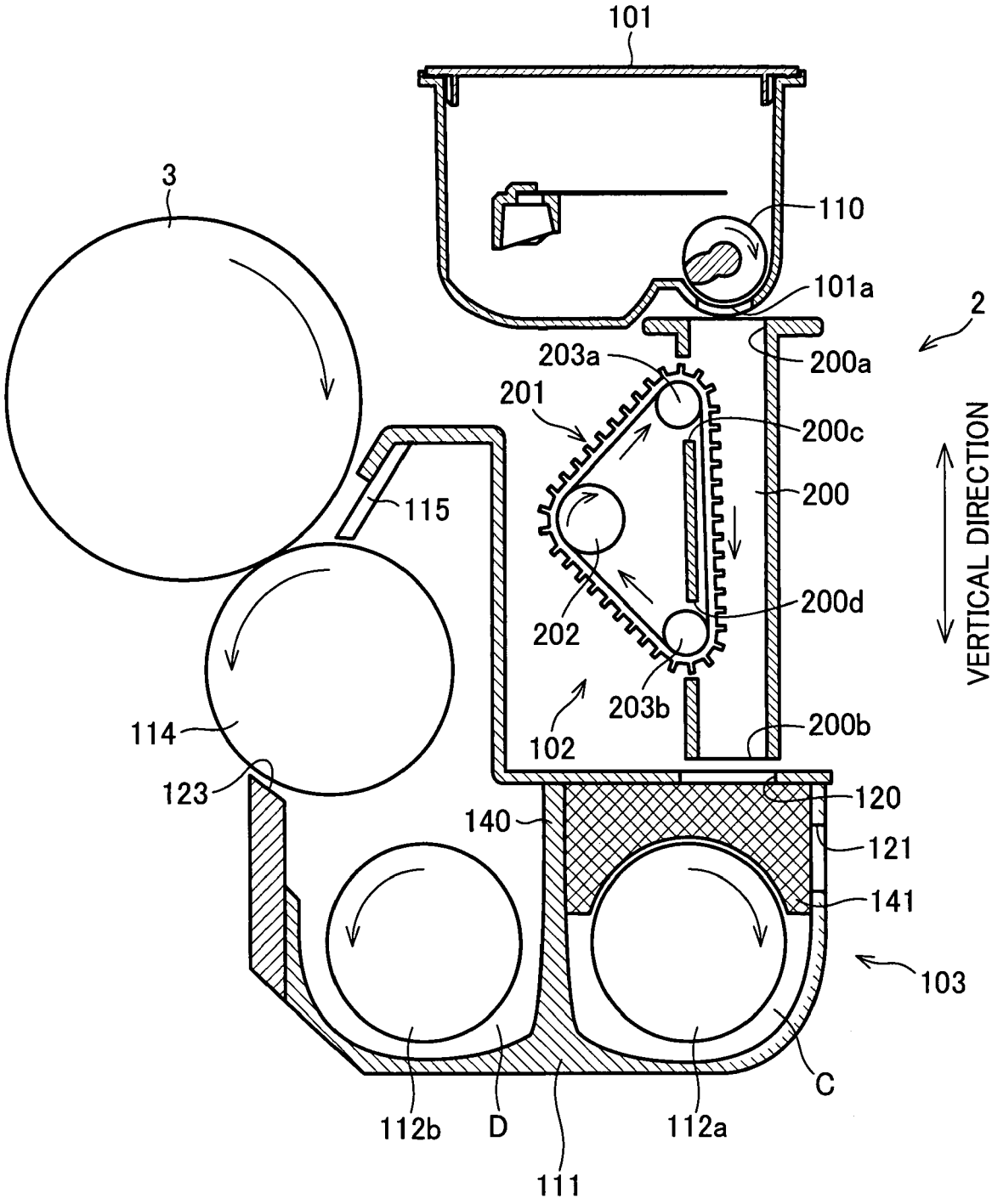
FIG. 3 is a schematic view of a development unit including the development apparatus shown in FIG. 1.

Next, the following explains details of development unit 2 provided in the image forming apparatus A. FIG. 3 is a schematic view of the development unit 2, viewed from a horizontal direction. As shown in FIG. 3, the development unit 2 includes a developer hopper 101, a developer transport mechanism 102, and a development apparatus 103.

The developer hopper 101 is provided in a portion higher than the development apparatus 103, and contains supplemental developer made of toner and carrier at a predetermined ratio. The carrier and toner may be mixed by a ratio of 1:9 (carrier:toner) for example, and this ratio of toner to the carrier is much higher compared with the developer in the developer container 111. Note that, the content of toner and carrier of the supplemental developer is adjusted to an appropriate ratio depending on toner charging amount, carrier particle diameter, or the structure of image forming apparatus A.

On the bottom of the developer hopper 101, a developer outlet 101*a* is provided. A developer supplying roller 110 is provided in the vicinity of the developer outlet 101*a* in the developer hopper 101.

The developer supplying roller 110 is a roller made of a porous elastic body such as urethane sponge. The developer supplying roller 110 transports developer from the developer hopper 101 to the developer outlet 101*a*. With this arrangement, when the developer supplying roller 110 is rotated in the developer hopper 101, the toner in the developer hopper 101 is carried to the developer outlet 101*a* little by little. The developer carried to the developer outlet 101*a* freely falls into the developer transfer tube 200 via the developer outlet 101*a* and an opening end 200*a*.

A developer transport mechanism 102 serves to supply toner from the developer hopper 101 to the development apparatus 103. The developer transport mechanism 102 is constituted of a developer transfer tube (developer transfer path) 200, a driving belt 201, a driving roller 202, and co-driving rollers 203*a* and 203*b*.

The developer transfer tube 200 is a path allowing developer to freely fall from the developer hopper 101 (sender end) so that the developer is supplied to the developer container 111 of the development apparatus 103 (receiver end). More specifically, the developer transfer tube 200 is provided between the developer hopper 101 and the developer container 111 so that one of the opening ends 200*a* of the developer transfer tube 200 faces to the developer outlet 101*a* of the developer hopper 101, while the other opening end 200*b* faces to the developer supply inlet 120 of the development apparatus 103.

With this structure, in the development apparatus 103, the internal part of the developer container 111 and the internal part of the developer hopper 101 become continuous via the developer transfer tube 200. Note that, the developer transfer tube 200 is provided between the developer hopper 101 and the developer container 111 so that the opening end 200*a* and the opening end 200*b* are positioned in parallel or substantially in parallel in the vertical direction of the tube 200.

The driving belt (transfer auxiliary member, cyclical driving member, belt member) 201 is a belt member setting around the peripheries of the co-driving rollers 203*a*/203*b* and the driving roller (driving section: driving method) 202, and is rotated by the movement of the driving roller 202. Irregular patterns are formed on the surface of the belt.

On the wall of the developer transfer tube 200, the through holes 200*c* and 200*d* are formed in parallel in the vertical direction. The two co-driving rollers 203*a* and 203*b* are provided on the through holes 200*c* and 200*d*. Further, the driving roller 202 is provided outside the developer transfer tube 200 to be opposite the two co-driving rollers 203*a* and 203*b*.

The driving roller 202 is positioned with its rotation axis orthogonal to the vertical direction of the tube 200 and its periphery opposite to the developer transfer tube 200. The co-driving rollers 203*a* and 203*b* are positioned with their rotation axes in parallel to the rotation axis of the driving roller 202.

With this layout of the co-driving rollers 203*a* and 203*b* and driving roller 202, it is possible to suspend the driving belt 201 by the co-driving roller 203*a* and 203*b* in the vertical direction in the developer transfer tube 200, as shown in FIG. 3.

When moving downward in the vertical direction of the developer transfer tube 200 by the rotation of the driving roller 202, the driving belt 201 moves downward (from the side of the developer hopper 101 to the side of the development apparatus 103 of the developer transfer tube 200) inside the developer transfer tube 200, and then moves upward again outside the developer transfer tube 200.

That is, the driving belt 201 circulates among the co-driving rollers 203*a* and 203*b* and the driving roller 202. Therefore, the free fall transfer of the developer is supported and facilitated by the moving force of the driving belt 201 as the developer comes closer or in contact with the driving belt 201. On this account, stagnation of developer in the developer transfer tube 200 is prevented, and blockage of developer transfer tube 200 due to accumulation/expansion of the developer stagnation does not occur.

The development apparatus 103 serves to visualize an electrostatic latent image formed on the photoconductive drum 3. To perform the visualization, the development apparatus 103 holds the developer by the development roller 114 and supplies toner to the surface of the photoconductive drum 3. The development apparatus 103 is arranged to constantly renew the developer as the developer is used.

Figure 1:
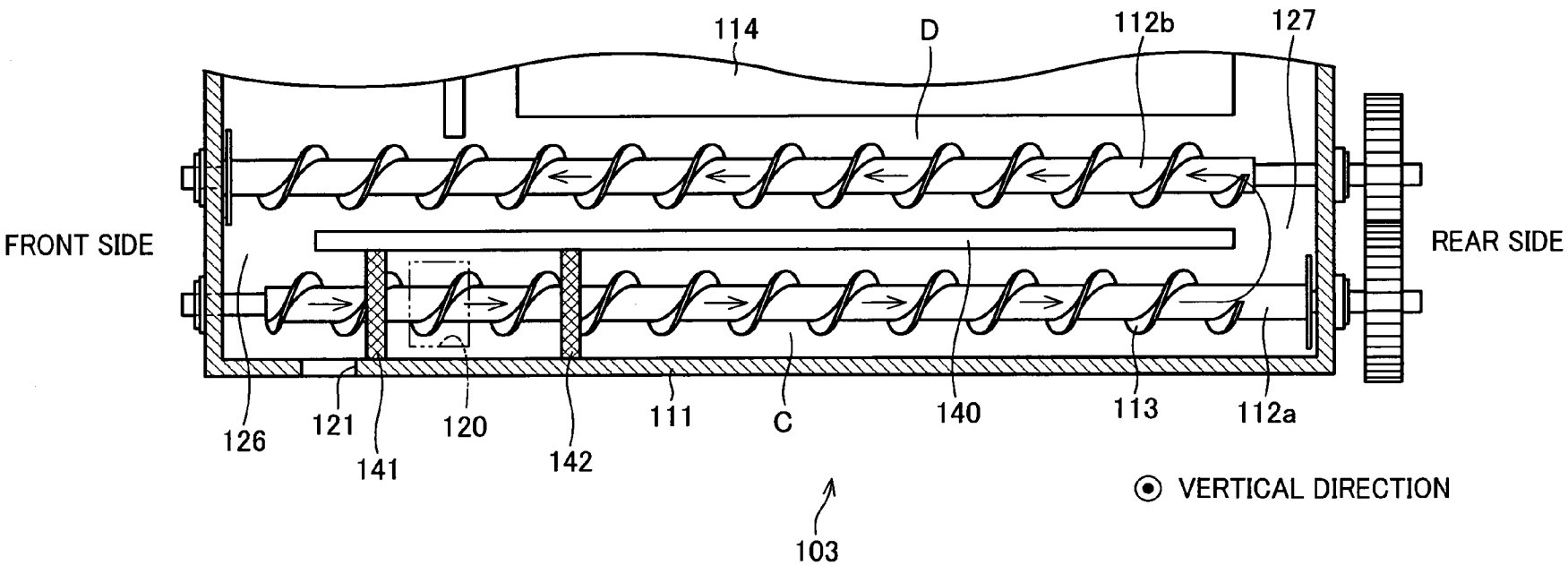
FIG. 1 is a schematic view of a development apparatus according to one embodiment, viewed from an upper vertical direction.

As shown in FIG. 1 and FIG. 3, the development apparatus 103 includes a developer container 111, a development roller (developer carrier) 114, a doctor blade 115, first and second carriage screws (stirring/carrying member) 112*a* and 112*b*, a partition plate 140, first and second regulation members 141 and 142. FIG. 1 is a schematic view of the inside of the developer container 111, viewed from an upper vertical direction.

The developer container 111 is a container for containing two-component developer (developer, hereinafter) made of toner and carrier. As shown in FIG. 3, the developer container 111 includes a development opening 123 in a portion opposite the photoconductive drum 3.

The development roller 114, made up of a magnet roller, supplies toner from the developer container 111 to the photoconductive drum 3. The development roller 114 is rotatably formed on a portion where the development opening 123 is formed, in the developer container 111. The rotation direction of the development roller 114 is opposite to the rotation direction of the photoconductive drum 3. That is, the movement directions of the photoconductive drum 3 and the development roller 114 are the same in their opposed surface.

A doctor blade is formed on the upper end of the development opening 123 of the developer container 111, adjacent to the development roller 114. The doctor blade serves to control thickness of the developer layer formed on the surface of the development roller 114.

The first and second carriage screws 112*a* and 112*b* carry developer to the development roller 114 while stirring the developer by respective stirring blades 113. The toner is charged by friction as it is stirred by the first and second carriage screws 112*a* and 112*b*.

As shown in FIGS. 1 and 3, the first and second carriage screws 112*a* and 112*b* are provided in parallel with the development roller 114, adjacent to the rear side of the development roller 114 (in parallel with the rotation axis direction of the development roller 114). In the present embodiment, the screw more distant from the development roller 114 is called a first carriage screw 112*a*, and the screw closer to the development roller 114 is called a second carriage screw 112*b*.

To distinguish between their areas, a partition plate 140 is provided between the first and second carriage screws 112*a* and 112*b*.

The partition plate 140 thus sections the developer container 111 into the first carriage path C where the first carriage screw 112*a* is provided, and a second carriage path D where the second carriage screw 112*b* is provided.

The partition plate 140 serves to section the entire internal portion of the developer container 111 except for the rear end and the front end of the container, i.e. the two end portions of the developer container 111 in the longitudinal direction. The two ends (the ends in the rotation axis direction of the first and second carriage screws 112*a*) of the partition plate 140 are separated from the wall of the container. This provision creates two connecting sections for connecting the first and second carriage paths C and D into the front and rear sides of the developer container 111. Hereinafter, the connecting section formed on the front end is referred to as a front connecting section 126, and the connecting section formed on the rear end is referred to as a rear connecting section 127.

Gears are provided on the rear side of the first and second carriage screws 112*a* and 112*b* for transmitting driving force from a driving section (driving means) such as a motor, and the first carriage screw 112*a* is rotated to carry developer from the front side to the rear side. The second carriage screw 112*b* is rotated inversely, from the rear side to the front side.

With this arrangement, the developer in the developer container 111 is carried by circulating through the first carriage path C and the second carriage path D. More specifically, the developer is carried from the front side to the rear side in the first carriage path C while stirred by the first carriage screw 112*a*, and then is carried to the second carriage path D through the rear connecting section 127. Then, the developer is carried from the rear side to the front side through the second carriage path D while stirred by the second carriage screw 112*b*, and travels back to the first carriage path C through the front connecting section 126. While the developer is carried in the second carriage path D, the development roller 114 adjacent to the second carriage screw 112*b* is constantly supplied with developer.

The first and second carriage screws 112*a* and 112*b* and the partition plate 140 constitutes a developer stirring/carrying mechanism (developer stirring carriage means), which serves to stir the developer in the developer container 111 while transferring it in the axis direction of the development roller 114. Further, the provision of the partition plate 140 creates first and second carriage paths C and D which are individual paths for the carriage screw 112*a* and 112*b*, thereby increasing efficiency in stirring/transferring the developer.

Further, the developer container 111 contains a developer supply inlet 120 for supplying new developer, and a developer outlet 121 for discharging developer no longer required due to the supply of new developer, as shown in FIG. 1 and FIG. 3.

As shown in FIG. 3, the developer supply inlet 120 is provided on the wall covering the upper part of the first carriage path C where the first carriage screw 112*a* is provided, in the front side of the developer container 111. The developer transport mechanism 102 having the developer hopper 101 thereabove is attached to the developer supply inlet 120. The new developer supplied from the supply inlet 120 into the developer container 111 is mixed with the existing developer by first and second carriage screws 112*a* and 112*b*, and are stirred and carried.

As shown in FIG. 1, the developer outlet 121 is formed on the side wall along the longitudinal direction of the first carriage path C where the first carriage screw 112*a* is provided, in the front side of the developer container 111. The overflowing developer container 111 with extra developer discharges the developer through the developer outlet 121, the discharge amount depending on the upper surface height of the developer.

A general developer outlet 121 is designed to discharge the same amount developer as the amount of developer supplied from the developer hopper 101, corresponding to the toner amount required for general photocopying. For example, assume the general photocopying uses a document with a 5% black solid ratio, 0.5 g of developer is supplied corresponding to the required toner amount, and the same amount of developer is discharged from the developer container 111.

Further, in this embodiment, the developer outlet 121 is provided in more upstream portion in the direction of the developer carried by the first carriage screw 112*a* than the developer supply inlet 120, so that the developer is discharged in more upstream portion than the section of supplying new developer. With this layout, the developer to be discharged has at least been stirred and carried by the first and second carriage screws 112*a* and 112*b* for one round through both the first and second carriage paths C and D. This securely prevents unwanted discharge of new developer having been just supplied.

A significant point of this structure is provision of first regulation member 141 which resides adjacent to the developer outlet 121 in a portion more downstream in terms of the developer carriage direction. The first regulation member 141 regulates the upper surface of the developer so as to regulate the amount of developer passing below.

As shown in FIG. 3, the first regulation member 141 has a circular arc lower end along the rotation path of the first carriage screw 112*a*. The first regulation member 141 is so provided in the first carriage path C as to fill the gap above the first carriage screw 112*a*.

Figure 4:
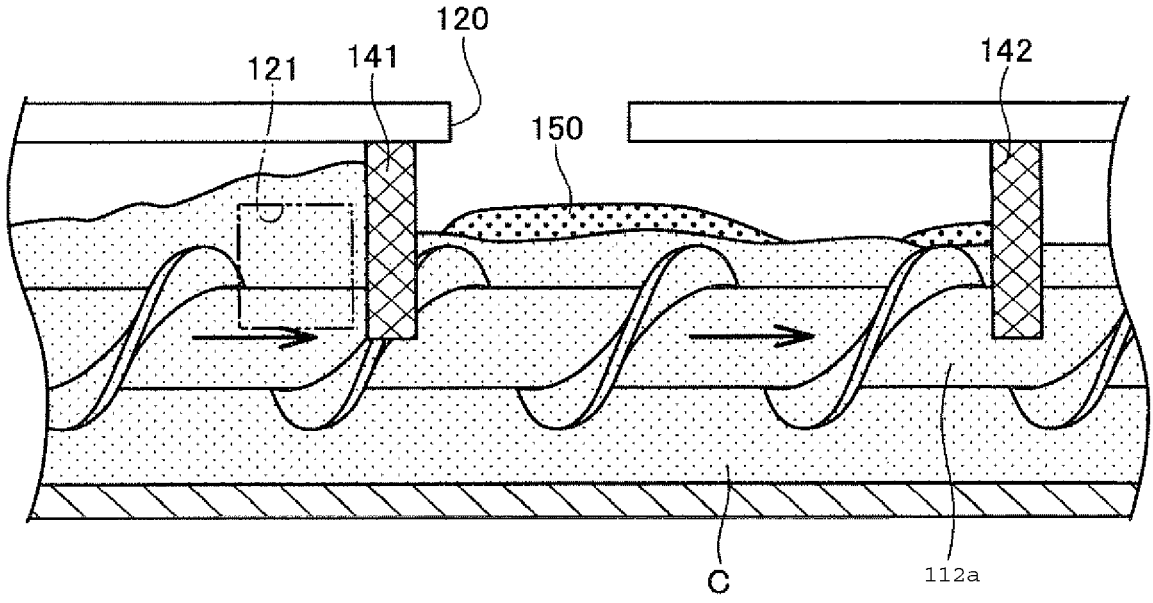
FIG. 4 is a schematic view showing a state of developer in the vicinity of a first regulation member in the development apparatus of FIG. 1.

With the provision of first regulation member 141, the surface of the developer being carried in the first carriage path C by the first carriage screw 112*a* is regulated, and only the part passing below the first regulation member 141 is carried to the downstream side. Therefore, as shown in FIG. 4, in the upstream portion of the developer carriage direction, the developer blocked by the first regulation member 141 is accumulated, and the upper surface of the developer increases.

Since the first regulation member 141 and the developer outlet 121 are adjacent to each other, the developer with the increased surface overflows, and is discharged from the developer outlet 121.

The amount of developer passing through the first regulation member 141 is constant regardless of the amount of developer stored in the developer container 111. Therefore, the increase in amount of extra developer in the developer container 111 proportionally increases the height of upper surface of the developer blocked and accumulated in the developer container 111.

Moreover, in the downstream of the first regulation member 141 in the developer carriage direction, the amount of developer is regulated by the first regulation member 141, and therefore is basically constant even though the amount varies due to supply or consumption during the return travel to the upstream of the first regulation member 141. The change in height of upper surface of the developer container 111 due to the increase in developer amount thus appears intensively in the upstream portion of the first regulation member 141 in the developer carriage direction.

Therefore, even if the change in height of upper surface is small for the whole developer container 111, it appears intensively in a certain point, and therefore appears as a large change in surface height in the vicinity of the developer outlet 121. Consequently, it becomes possible to discharge the extra developer right away from the developer outlet 121. The developer amount in the developer container 111 is thus kept within an appropriate range.

Moreover, since the surface projection of extra developer is caused by the blockage of developer by the first regulation member 141, it is not easily affected by other parameters than the developer amount (such as the developer fluidity etc.), compared with the projection formed by a stirring wing of the carriage screw. Therefore, in spite of slight variation due to the developer fluidity, the height of the projection proportionally increases with an increase of extra developer, that is it proportionally decreases with a decrease of extra developer. This arrangement allows not only quick discharge of extra developer, but also suppressing influence of developer fluidity etc., thereby maintaining the developer amount in the developer container 111 within an appropriate range.

Further, as described, in the area outside the developer accumulation region in the upstream of the first regulation member 141, the surface height of the developer is kept constant. Therefore, the development is securely performed with stable stirring performance and development performance by the first and second carriage screws 112*a* and 112*b*, including the time period until the extra developer overflows and is discharged.

Further, in the image forming apparatus A, the second regulation member 142 is provided in the first carriage path C in a portion more downstream than the developer supply inlet 120 in the developer carriage direction. The second regulation member 142 regulates the surface of developer. As shown in FIG. 4, the developer 150 newly supplied is often carried above the flow of the existing developer as a separate flow. However, with the regulation of developer surface by the second regulation member 142, the new developer is efficiently mixed with the flow of the existing developer by the stirring operation of the first carriage screw 112*a*. A further stable development is thus ensured.

Further, in the image forming apparatus A, the first regulation member 141 is provided in the vicinity of the end portion of the first carriage screw 112*a* which is the end in the upstream of the developer carriage direction, and therefore stirring and carriage by the first carriage screw 112*a* may be performed with the constant amount of developer in the entire part of the carriage path C. Therefore, the development is securely performed with stable stirring performance and development performance, compared with the structure in which the first regulation member 141 is provided in the vicinity of the end portion of the first carriage screw 112*a* on the downstream side of the developer carriage direction.

When the plane on which the image forming apparatus A is set is inclined and therefore the two ends of the development apparatus 103 in the axis direction of the development roller 114 are positioned at different heights, the surface of the stored developer is inclined with respect to the developer container 111. If this inclination occurs in the structure in which the developer outlet 121 is provided in the axis direction end of the development roller 114, the developer amount in the developer container 111 decreases when the developer outlet 121 is provided in a lower portion. On the other hand, when the developer outlet 121 is provided in an upper portion, the developer amount in the developer container 111 increases. The amount of developer is thus not stable in either case.

Figure 5:
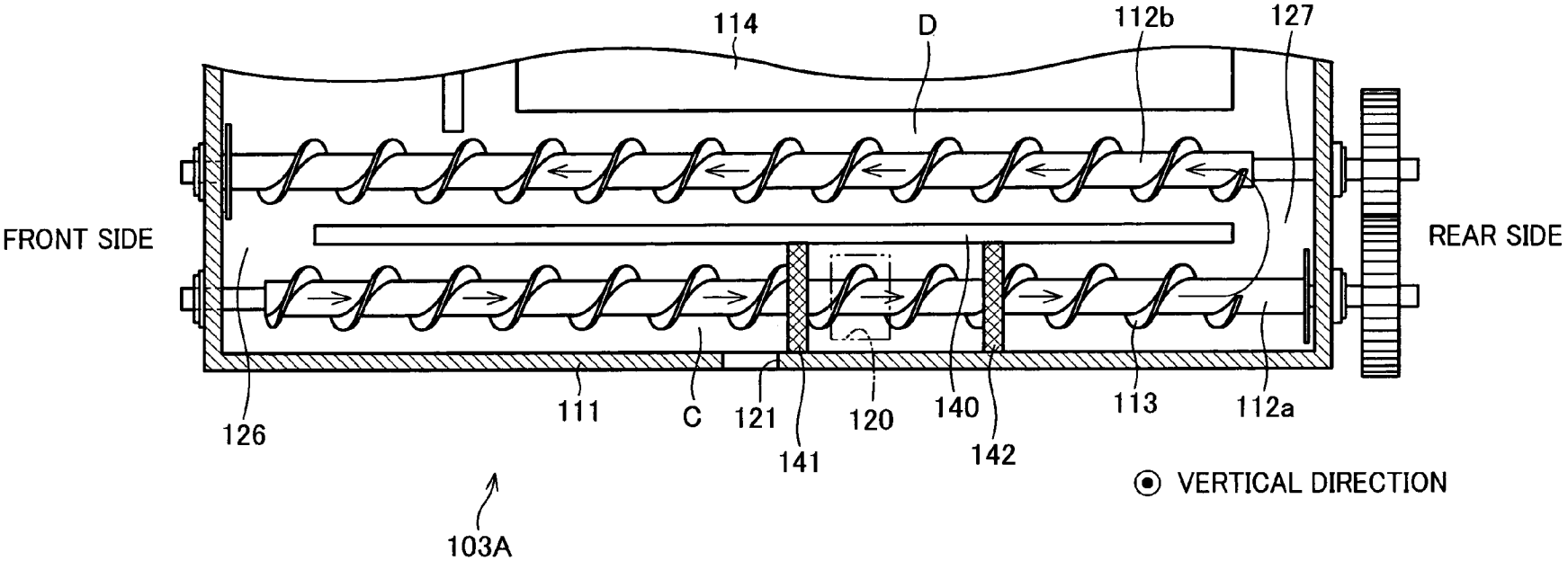
FIG. 5 is a schematic view of a development apparatus according to one embodiment, viewed from an upper vertical direction.

In view of this drawback, FIG. 5 shows another preferable development apparatus 103A in which the first regulation member 141 is provided in the central portion of the first carriage screw 112*a*, in other words, in the central portion of the first carriage path C.

As shown in FIG. 5, the first regulation member is provided in the central portion of the carriage path of the first stirring/carrying member, and the developer outlet 121 and the developer supply inlet 120 are also provided in the central portion. This structure has less influence of inclination of the development apparatus 103, and therefore more stable even under inclination of the apparatus.

As described, a development apparatus comprises: a developer container for containing developer made of carrier and toner, said developer container having an opening opposite an electrostatic latent image carrier, a developer supply inlet through which new developer including carrier is supplied, and a developer outlet through which developer is discharged; a developer carrier for holding and carrying developer, rotatably positioned in a portion facing to the opening of said developer container; a developer stirring/carrying mechanism, rotatably provided in a rear side of said developer carrier, for carrying the developer into a direction in parallel to an axis of the developer carrier, while stirring the developer; and a first regulation member for regulating an upper surface of developer, provided on an adjacent and downstream portion with respect to said developer outlet in terms of travel direction of developer carried by said developer stirring/carrying mechanism.

With this arrangement having a first regulation member, the upper surface of the developer carried by the first stirring/carrying member is regulated, and only the part passing below the first regulation member is carried to the downstream side. Therefore, in the upstream portion of the first regulation member in the developer carriage direction, the developer blocked by the first regulation member is accumulated, and the upper surface of the developer increases. Since the first regulation member and the developer outlet are adjacent to each other, the developer with the increased surface overflows, and is discharged from the developer outlet.

The amount of developer passing through the first regulation member is constant regardless of the amount of developer stored in the developer container. Therefore, the increase in amount of extra developer in the developer container proportionally increases the height of upper surface of the developer blocked and accumulated in the developer container.

Moreover, in the downstream of the first regulation member in the developer carriage direction, the amount of developer is regulated by the first regulation member, and therefore is basically constant even though the amount varies due to supply or consumption during the return travel to the upstream of the first regulation member. The change in height of upper surface of the developer container due to the increase in developer amount thus appears intensively in the upstream portion of the first regulation member in the developer carriage direction.

Therefore, even if the change in height of upper surface is small for the whole developer container, it appears intensively in a certain point, and therefore appears as a large change in surface height in the vicinity of the developer outlet. Consequently, it becomes possible to discharge the extra developer right away from the developer outlet. The developer amount in the developer container is thus kept within an appropriate range.

Moreover, since the surface projection of extra developer is caused by the blockage of developer by the first regulation member, it is not easily affected by other parameters than the developer amount (such as the developer fluidity etc.), compared with the projection formed by a stirring wing of the carriage screw. Therefore, in spite of slight variation due to the developer fluidity, the height of the projection proportionally increases with an increase of extra developer, that is it proportionally decreases with a decrease of extra developer. This arrangement allows not only quick discharge of extra developer, but also suppressing influence of developer fluidity etc., thereby maintaining the developer amount in the developer container within an appropriate range.

Further, in the area outside the developer accumulation region in the upstream of the first regulation member, the surface height of the developer is kept constant. Therefore, the development is securely performed with stable stirring performance and development performance, including the time period until the extra developer overflows and is discharged.

Another development apparatus comprises: a developer container for containing developer made of carrier and toner, said developer container having an opening opposite an electrostatic latent image carrier, a developer supply inlet through which new developer including carrier is supplied, and a developer outlet through which developer is discharged; a developer carrier for holding and carrying developer, rotatably positioned in a portion facing to the opening of said developer container; a developer stirring/carrying mechanism, rotatably provided in a rear side of said developer carrier, for carrying the developer into a direction in parallel to an axis of the developer carrier, while stirring the developer, said developer stirring/carrying mechanism having first and second stirring/carrying members and a partition plate for separating the first and second stirring/carrying members except for ends of said first and second stirring/carrying members; and a first regulation member for regulating an upper surface of developer, provided in a carriage path of the first stirring/carrying member which resides in a portion more distant from said developer carrier then the second stirring/carrying member, said developer outlet is formed on an adjacent and upstream portion with respect to said first regulation member in terms of travel direction of developer.

In this structure, the developer stirring/carrying mechanism is constituted of first and second stirring/carrying members and a partition plate for separating the first and second stirring/carrying members except for ends of said first and second stirring/carrying members. The provision of first and second stirring/carrying member enables circulation carriage, and the partition plate allows the two carriage paths to be separated. The efficiencies of stirring and carriage thus increase. In this structure, the first regulation member is provided in a carriage path of the first stirring/carrying member which is more distant from the developer carrier than the second stirring/carrying member. This structure thus ensures the same effect as that of the foregoing development apparatus.

In this development apparatus, the first regulation member is preferably provided in the vicinity of an upstream end of the carriage path of the first stirring/carrying member in terms of travel direction of developer. In this structure, stirring and carriage by the first stirring/carrying member may be performed with the constant amount of developer in the entire part of the stirring/carriage path. Therefore, the development is securely performed with stable stirring performance and development performance, compared with the structure in which the first regulation member is provided in the vicinity of the end portion of the first stirring/carrying member on the downstream side of the developer carriage direction.

It is also preferable that said first regulation member is provided in a center of the carrier path of said first stirring/carrying member.

When the plane on which the image forming apparatus is set is inclined and therefore the two ends of the development apparatus in the axis direction of the development roller are positioned at different heights, the surface of the stored developer is inclined with respect to the developer container. If this inclination occurs in the structure in which the developer outlet is provided in the axis direction end of the development roller, the developer amount in the developer container decreases when the developer outlet is provided in a lower portion. On the other hand, when the developer outlet is provided in an upper portion, the developer amount in the developer container increases. The amount of developer is thus not stable in either case. Therefore, the foregoing structure in which the first regulation member is provided in the central portion of the carriage path of the first stirring/carrying member is subjected to less influence of inclination of the development apparatus, and therefore is more stable under inclination of the apparatus.

The foregoing development apparatus is preferably further arranged so that said developer supply inlet is provided in a portion more downstream than said first regulation member in the carriage path of said first stirring/carrying member in terms of travel direction of developer.

With this arrangement, the newly supplied developer reaches the developer outlet after mixed with the existing developer. Therefore, the discharge amount of newly supplied developer is reduced, that is, the content of used developer in the discharged developer increases. Also, the position close to the first regulation member needs a longer time to reach the developer outlet, and the stirring time can be increased.

Further, in the structure in which said developer supply inlet is provided in a portion more downstream than said first regulation member in terms of travel direction of developer, it is possible to further provide a second regulation member for regulating a surface of developer, in a portion more downstream than said developer supply inlet in the carriage path of said first stirring/carrying member in terms of travel direction of developer.

With this arrangement, the amount of stirred and carried developer is kept constant by the second regulation member even after new developer is supplied. Further, it is possible to mix the new developer with the existing developer being stirred and carried.

Said first and second regulation members includes a circular arc plane extending along an external shape of the stirring/carrying member when the stirring/carrying member is rotated. With this arrangement, it is not necessary to provide to the stirring/carrying member some kind of mechanism for avoiding interference with the first or second regulation member.

An image forming apparatus includes the foregoing development apparatus of the present disclosure.

The present technology thus provides a certain effect of provision of a development apparatus capable of maintaining appropriate amount of developer in the developer container by reducing influence of developer fluidity or the like. With stable stirring performance and development performance, the development apparatus performs secure development, including the time period until the extra developer overflows and is discharged. The present technology also provides an image forming apparatus including the development apparatus.

The present technology is not limited to the description of the embodiments above, but may be altered by a skilled person within the scope of the claims. An embodiment based on a proper combination of technical means disclosed in different embodiments is encompassed in the technical scope of the present disclosure.

Though the developer supply used in the foregoing embodiment contains both carrier and toner at a predetermined proportion, the effect can also be obtained with separate supply of carrier and toner.

The embodiments and concrete examples of implementation discussed in the foregoing detailed explanation serve solely to illustrate the technical details, which should not be narrowly interpreted within the limits of such embodiments and concrete examples, but rather may be applied in many variations, provided such variations do not exceed the scope of the patent claims set forth below.

What is claimed is:

1. A development apparatus, comprising:

a developer container for containing developer made of carrier and toner, said developer container having an opening opposite an electrostatic latent image carrier, a developer supply inlet through which new developer including carrier is supplied, and a developer outlet through which developer is discharged;

a developer carrier for holding and carrying developer, rotatably positioned in a portion facing to the opening of said developer container;

a developer stirring/carrying mechanism, rotatably provided behind said developer carrier, for carrying the developer in a direction in parallel to a longitudinal axis of the developer carrier, while stirring the developer wherein the developer stirring/carrying mechanism includes at least one rotating member having a spiral blade along its length; and a first regulation member that regulates a height of an upper surface of the developer, provided adjacent to and downstream of said developer outlet in terms of a travel direction of the developer carried by said developer stirring/carrying mechanism, wherein an arcuate bottom surface of the first regulation member is located over the at least one rotating member so that it does not interfere with the spiral blade.

2. The development apparatus as set forth in claim 1, wherein the first regulation member is provided in the vicinity of an upstream end of a carriage path of said developer stirring/carrying mechanism in terms of the travel direction of the developer carried by the developer stirring/carrying mechanism.

3. The development apparatus as set forth in claim 1, wherein said first regulation member is provided in a center of a carriage path of said developer stirring/carrying mechanism.

4. The development apparatus as set forth in claim 1, wherein said developer supply inlet is provided in a portion more downstream than said first regulation member in a carriage path of said developer stirring/carrying mechanism.

5. The development apparatus as set forth in claim 4, further comprising a second regulation member for regulating a height of an upper surface of developer, provided in a portion more downstream than said developer supply inlet in the carriage path of said developer stirring/carrying member.

6. The development apparatus as set forth in claim 5, wherein a bottom surface of the second regulation member includes a circular arc plane extending along an external shape of the spiral blade of the at least one rotating member.

7. An image forming apparatus comprising the development apparatus of claim 1.

8. The development apparatus as set forth in claim 1, wherein the at least one rotating member comprises:

a first carrying/stirring member that is rotatably mounted on the developer container and that conveys developer in a first direction;

a second carrying/stirring member that is rotatably mounted on the developer container and that conveys developer in a second direction opposite the first direction, wherein a spiral blade extends along a length of the second carrying/stirring member, and wherein the arcuate bottom surface of the first regulation member is located just above a path swept out by the spiral blade as the second carrying/stirring member rotates.

9. The development apparatus of claim 8, wherein the developer outlet is located in a sidewall of the developer container adjacent the second carrying/stirring member and upstream of the first regulation member in terms of the travel direction of developer carried by the second carrying/stirring member.

10. The development apparatus of claim 9, wherein the developer supply inlet is located over the second carrying/stirring member and downstream of the first regulation member in terms of the travel direction of developer carried by the second carrying/stirring member.

11. The development apparatus of claim 10, further comprising a second regulation member that regulates a height of an upper surface of developer in the developer container, wherein the second regulation member is located over the second carrying/stirring member and downstream of the developer supply inlet in terms of the travel direction of developer carried by the second carrying/stirring member.

12. The development apparatus of claim 11, wherein an arcuate lower surface of the second regulation member is located just above a path swept out by the spiral blade as the second carrying/stirring member rotates.

13. A development apparatus, comprising:

a developer container for holding developer and having an opening along one side thereof, a developer supply inlet and a developer outlet;

a developer carrier roller that is rotatably mounted in the opening of the developer container;

a first carrying/stirring member that is rotatably mounted on the developer container parallel to and adjacent the developer carrier roller and that conveys developer in a first direction;

a second carrying/stirring member that is rotatably mounted on the developer container parallel to and adjacent the first carrying/stirring member and that conveys developer in a second direction opposite the first direction, wherein the developer supply inlet is located over the second carrying/stirring member, wherein a spiral blade is formed along a length of the second carrying/stirring member;

a first regulation member that regulates a height of an upper surface of developer carried by the second carrying/stirring member, wherein an arcuate lower surface of the first regulation member is located just above a path swept out by the spiral blade as the second carrying/stirring member rotates;

a developer hopper located over the developer container for holding supplemental developer, wherein the developer hopper has a hopper outlet;

a developer transfer tube connecting the hopper outlet of the developer hopper to the developer supply inlet of the developer container; and a developer transport mechanism that moves developer along the developer transfer tube from the developer hopper to the developer container.

14. The development apparatus of claim 13, wherein the developer transport mechanism comprises a belt that moves along a wall of the developer transfer tube.

15. The development apparatus of claim 13, wherein the developer supply inlet is located downstream of the first regulation member with respect to a travel direction of developer carried by the second carrying/stirring member, and wherein the developer outlet is located upstream of the first regulation member with respect to a travel direction of developer carried by the second carrying/stirring member.

16. The development apparatus of claim 15, further comprising a second regulation member that regulates a height of an upper surface of developer carried by the second carrying/stirring member, wherein the second regulation member is located downstream of the developer supply inlet with respect to the travel direction of developer carried by the second carrying/stirring member.

17. The development apparatus of claim 13, further comprising a developer supplier roller that is rotatably mounted in the developer hopper over the hopper outlet, wherein rotation of the developer supplier roller conveys small measured amounts of developer from the developer hopper to the hopper outlet.

18. The development apparatus of claim 17, wherein the developer supplier roller has an outer surface formed of a soft porous elastic material.

* * * * *